United States Patent [19]

Becker

[11] Patent Number: 4,604,852

[45] Date of Patent: Aug. 12, 1986

[54] PROCESS AND APPARATUS FOR PRODUCING CONSECUTIVE PACKAGES FOR DRINKING STRAWS OR THE LIKE

[75] Inventor: Gert Becker, Bremen, Fed. Rep. of Germany

[73] Assignee: Overbeck GmbH & Co., Bremen, Fed. Rep. of Germany

[21] Appl. No.: 583,263

[22] Filed: Feb. 24, 1984

[30] Foreign Application Priority Data

Mar. 5, 1983 [DE] Fed. Rep. of Germany ..... 3307941

[51] Int. Cl.[4] ..... B65B 19/34

[52] U.S. Cl. ..... 53/444; 53/148; 53/451; 53/453; 53/553; 53/559

[58] Field of Search ..... 53/148, 444, 450, 451, 53/453, 454, 548, 553, 554, 555, 559, 560

[56] References Cited

U.S. PATENT DOCUMENTS

| | | | |
|---|---|---|---|
| 2,578,799 | 12/1951 | Grey | 53/553 X |
| 3,333,393 | 8/1967 | Sparks | 53/559 X |
| 3,871,155 | 3/1975 | Blaser | 53/559 X |
| 4,384,441 | 5/1983 | Maruyama et al. | 53/553 |

FOREIGN PATENT DOCUMENTS

| | | | |
|---|---|---|---|
| 0022595 | 1/1981 | European Pat. Off. | 53/553 |
| 2488213 | 2/1982 | France | 153/553 |
| 247936 | 8/1926 | United Kingdom | 53/148 |
| 2098971 | 12/1982 | United Kingdom | 53/148 |

*Primary Examiner*—E. R. Kazenske
*Assistant Examiner*—Michael D. Folkerts
*Attorney, Agent, or Firm*—Fleit, Jacobson, Cohn & Price

[57] ABSTRACT

A process and an apparatus for producing consecutive packages for drinking straws or the like in bands of straws. The drinking straws are extracted directly from a funnel-shaped vessel by a suction roller having straw-receiving grooves distributed uniformly over the periphery and which are connected to a vacuum source. The straws are transferred individually and at a fixed rate from the suction roller to a conveyor roller, over which one of the packaging foils is guided, the transfer being carried out by means of at least one transfer finger movable to and fro transversely to the path of movement of the straws. The transfer finger presses the straws, together with an underlying packaging foil, into receiving grooves in the conveyor roller. Contacting the conveyor roller is a mating roller, over which an outer packaging foil is guided and which serves at the same time as a sealing roller. The straws are sealed in between the two foils in the roller gap between the conveyor roller and the mating roller.

19 Claims, 7 Drawing Figures

PROCESS AND APPARATUS FOR PRODUCING CONSECUTIVE PACKAGES FOR DRINKING STRAWS OR THE LIKE

BACKGROUND OF THE INVENTION

1. Field of the Invention

The invention relates to a process and an apparatus for producing packages for drinking straws, and more particularly to a process and appartus for continuously producing consecutive, spaced individual packages for drinking straws.

2. Description of the Related Art

In a known construction (European Patent Specification No. 22,595), the straws to be packaged fall from a supply funnel located at a higher point through a vertical shaft onto a lower bucket wheel which serves as a straw-separating device and which has straw receptacles arranged at a distance from one another and taking the form of grooves extending approximately parallel to the axis of rotation. A conveyor roller with straw-receiving grooves arranged at the same distance from one another is assigned to the abovementioned bucket wheel, the receiving grooves each being connected to a vacuum source. One of the two packaging foils is guided over the conveyor roller. At the same time, the foil is pressed by means of an appropriately rotating tool into the straw-receiving grooves and fixed in these by means of suction air. The drinking straws are then fed by the first-mentioned bucket wheel into the grooves provided with the foil. The other packaging foil, which is guided over a sealing roller assigned to the conveyor roller, is subsequently applied. The two foils are then sealed in a known way so as to enclose the straws arranged at a distance from one another.

A disadvantage of the known construction is, on the one hand, the vertical fall shaft. This is the main cause of low productivity, because the drinking straws do not fall down the shaft sufficiently quickly as a result of electrostatic charging and their own light weight. Moreover, blockage of the fall shaft by drinking straws lying across it cannot be prevented in a reliable way.

On the other hand, it is relatively expensive to fix the one packaging foil in the receiving grooves of the conveyor roller, and a considerable suction power has to be exerted to keep the foil in its correct shape in the grooves.

SUMMARY OF THE INVENTION

As a result of the invention, it will be possible to achieve a higher continuous output than in the known state of the art, while ensuring an increased working speed and a reduced outlay in terms of construction and energy.

It is particularly important, here, that the drinking straws or the like are introduced into the region between the converging foils so as to be guided positively without falling. In this way, a high precision and operating reliability are guaranteed even at very high working speeds.

Preferred details relating to the process and to the constsruction are described in more detail hereafter. As a result of these measures, it is guaranteed that the straws will be received reliably by the straw-separating device and introduced between the two foil sheets.

BRIEF DESCRIPTION OF THE DRAWINGS

A particularly preferred constructive embodiment of a packaging apparatus according to the invention, by means of which the process according to the invention can be carried out, is explained in more detail below with reference to the attached drawing in which.

DESCRIPTION OF THE PREFERRED EMBODIMENTS

Figure 1:
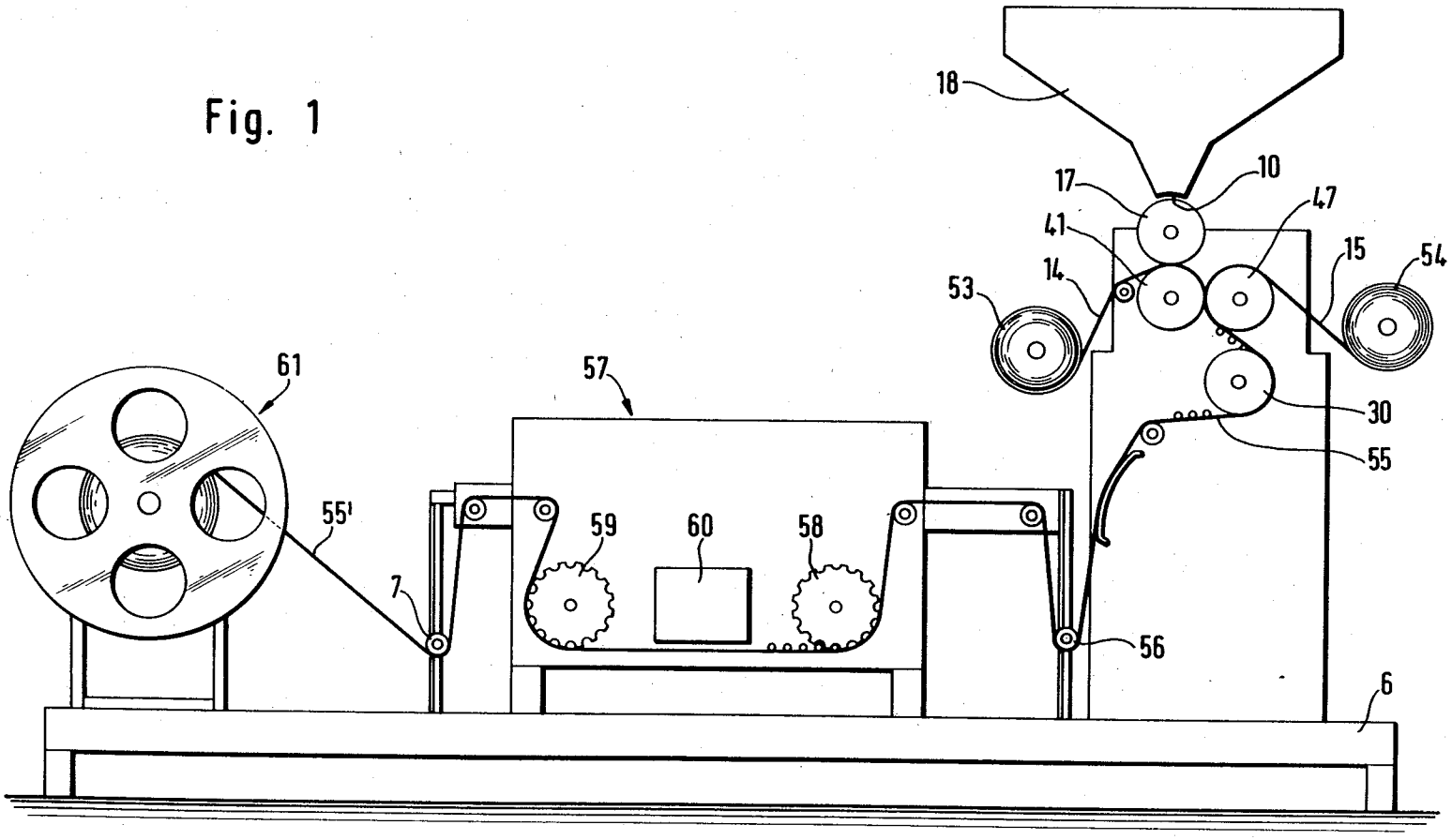
FIG. 1 shows a diagrammatic general view of a straw-band machine with the apparatus according to the invention for introducing the straws into the region between the two converging packaging foils.

The straw-band machine according to FIG. 1 consists of a straw supply funnel 18, a straw-separating device located underneath the funnel orifice 10 and taking the form of a suction roller 17 described in more detail below, by means of which the drinking straws 13 or the like are extracted directly from the funnel 18, and a foil supply device located underneath the straw-separating device and with a conveyor roller 41, assigned directly to the straw-separating device, and a mating roller 47 which is assigned to the conveyor roller and over which either one of the two packaging foils 14, 15 is guided. The foils 14 and 15 are drawn off from foil reels 53, 54. The conveyor roller 41 and/or the mating roller 47 are provided with foil-sealing devices, that is to say with cylindrical surfaces or cylindrical-surface parts which can be heated to the sealing temperature. Located after these two rollers 41, 47 is a draw-off roller 30 which serves both for cooling and stabilizing the band of straws formed between the conveyor roller 41 and the mating roller 47 and which performs the function of a so-called "format roller". In the deflection region of the draw-off roller 30, the foils 14, 15 sealed or welded to one another are cooled, specifically with the exactly predetermined distance between the drinking straws being maintained. Consequently, the precise format of the band of straws is stabilized in this region.

The band of straws 55 is subsequently guided over a so-called compensating roller 56 which, in the embodiment according to FIG. 1, is mounted so as to be movable up and down in a vertical plane and which allows subsequent intermittent movement of the band of straws 55 in the punching region 57. The punching region 57 comprises two bucket wheels or grooved rollers 58, 59 which are arranged at a distance from one another and are driven intermittently, that is to say stepwise, and between which a punching device 60 is located. Severing cuts and/or punched perforations are made by the punching device 60 during a momentary standstill of the band of straws 55, specifically preferably, each time in the region between two straws 13 enclosed by the foils 14, 15, at least three severing cuts which extend in a line and parallel to the straws 13 and are at a distance from one another and of which the ends facing one another are each provided with a punched perforation, the severing cuts and punched perforations being made simultaneously or in succession within the cycle of movement of the band of straws 55. Finally, the band of straws 55' punched or provided with partial severing cuts in this way is wound onto a drum 61, from which it can then be drawn off again to be applied to drink packs.

The apparatus for extracting the drinking straws from the filling and supply funnel 18 and for introducing the drinking straws into the region between the two converging packaging foils 14, 15 will now be explained in more detail with reference to FIGS. 2 to 7. The same reference numerals are used here for the same parts.

Figure 2:
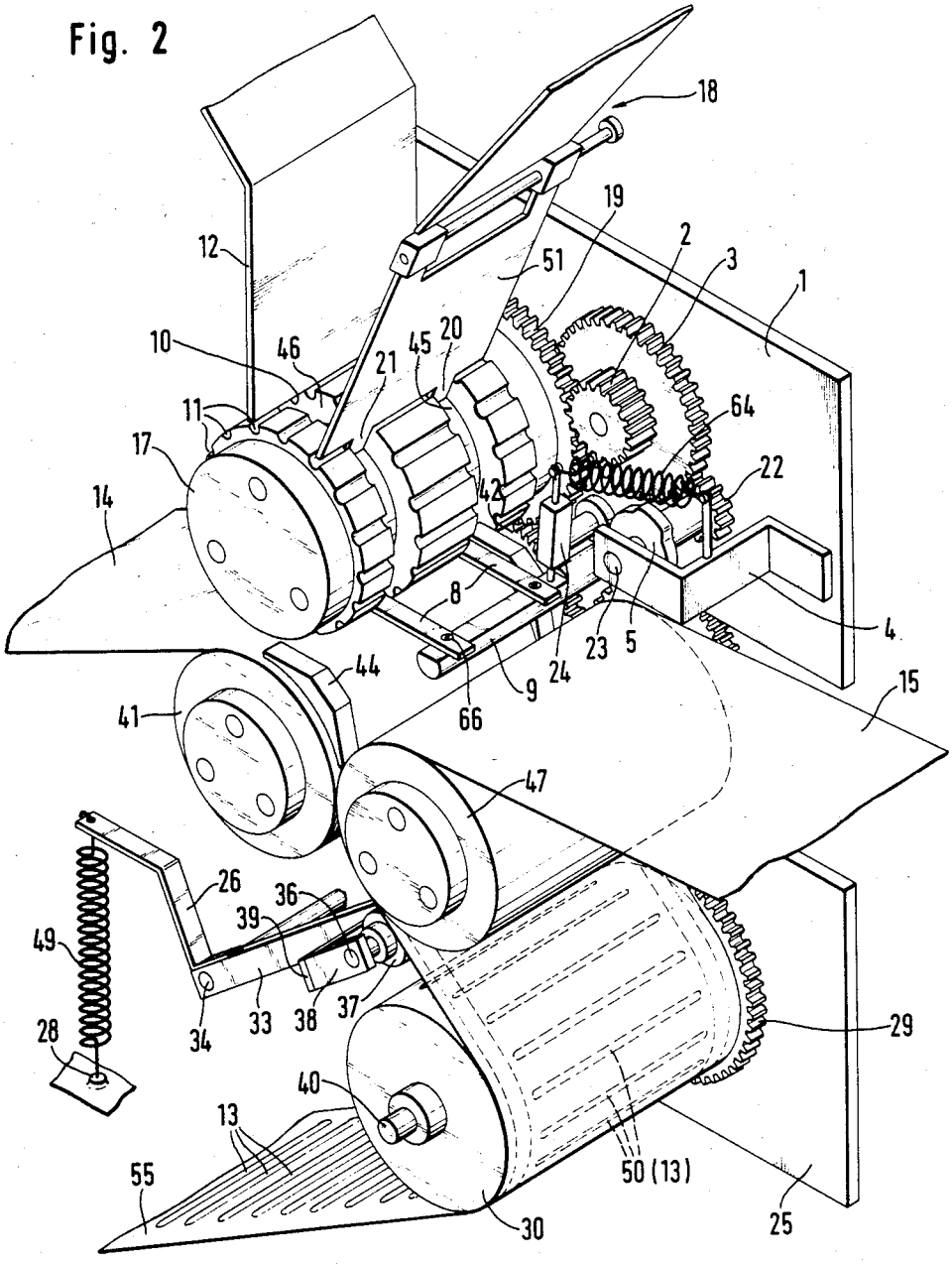
FIG. 2 shows, in a perspective view, the apparatus for introducing the straws into the region between the converging packaging foils.
Figure 3:
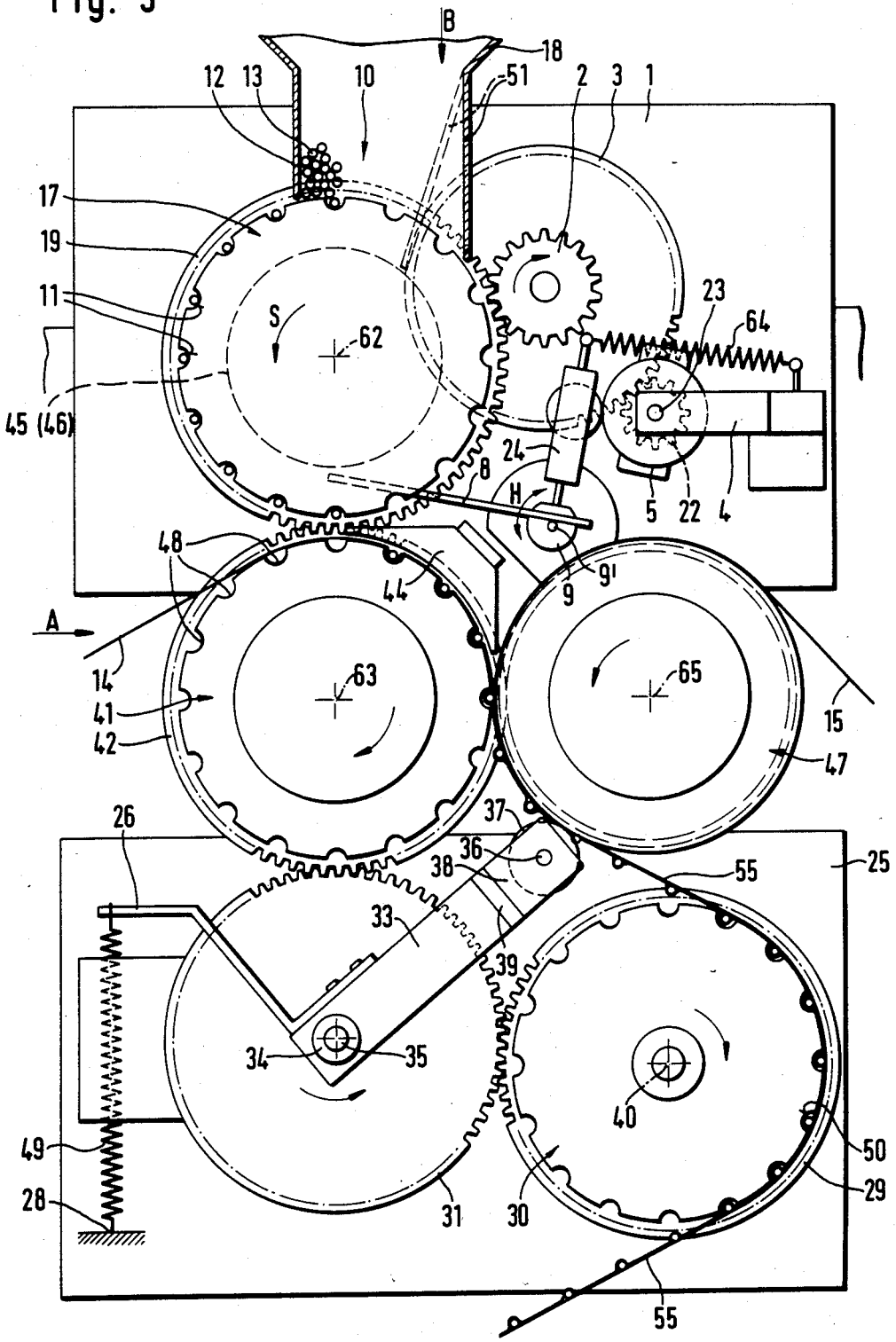
FIG. 3 shows the apparatus according to FIG. 2, in a front view.

As can be seen very clearly from FIGS. 2 and 3, drinking straws 13 are extracted directly from the filling and supply funnel 18 by means of a suction roller 17 guided past the lower orifice 10 of the funnel 18 and having straw-receiving grooves 11 which are distributed uniformly over the periphery of the latter and each extend approximately parallel to the axis of rotation 62 of the suction roller 17 and which can each be connected to a vacuum source, at least over the straw transport path. The design of a suction roller of this type is known per se, so that there is no need to describe its constructive design in any more detail at this point. The drinking straws 13 are therefore taken up, in the region of the lower funnel orifice 10, by the straw-receiving grooves 11 of the suction roller 17 and retained by means of a slight vacuum in the straw-receiving grooves 11, until they pass into the region of transfer to a conveyor roller 41 located underneath the suction roller 17. The conveyor roller 41 likewise has straw-receiving grooves 48 which are distributed over the periphery at the same distance from one another as on the suction roller 17 and which extend parallel to the axis of rotation 63 of the conveyor roller 41. As already noted above with regard to FIG. 1, one of the two packaging foils, namely the foil sheet 14, is guided over the conveyor roller 41. A mating roller 47, over which the other foil sheet 15 is guided, is assigned to the conveyor roller 41. The drinking straws 13 are transferred individually and at a fixed rate from the straw-receiving grooves 11 of the suction roller 17 into the straw-receiving grooves 48 of the conveyor roller 41 by means of two transfer fingers 8, which are arranged at a distance from one another in the direction of the axes of rotation 62 and 63 and which can be moved to and fro transversely to the path of movement of the straws 13, that is to say, in the embodiment according to FIG. 3, can be moved up and down in the direction of the arrow H about the pivot axis 9' defined by the shaft 9. As can be seen, in particular, from FIGS. 2, 4 and 5, the suction roller 17 has, in the region of each of the two transfer fingers 8, a peripheral groove 45, 46 into which the transfer fingers 8 are received in their initial position lifted in FIG. 3. Consequently, the peripheral grooves or turned-in portions 45, 46 allow the two transfer fingers 8 to enter in the lower transfer region of the suction roller 17.

The transfer fingers 8 in the lower region of the suction roller 17, which are movable up and down at a high frequency, have a double function:

transferring the straws 13 from the suction roller 17 to the conveyor roller 41;

pressing the straws 13, together with the foil 14, into the receiving grooves 48.

Consequently, the foil 14 is molded into the receiving grooves 48 by means of the straws 13. The straws 13 are transferred from the suction roller 17 to the conveyor roller 41 whenever the straw-receiving grooves 11 and 48 of the suction roller 17 and conveyor roller 41 are located opposite one another. A cam control is designed in an appropriate way for the up-and-down movement of the transfer fingers 8 and comprises a cam plate 5 which is driven by the central drive, described in more detail further below, of the apparatus as a whole. The cam plate 5 interacts with a cam lever 24 which is connected rigidly to the shaft 9 and which is held up against the cam plate 5 by means of a tension spring 64. The axis of rotation 23 of the cam plate 5 extends, like the axis of rotation 65 of the mating roller 47, parallel to the axes of rotation 62, 63 of the suction roller 17 and conveyor roller 41. The transfer fingers 8 are connected firmly, preferably releaseably by means of fastening screws 66 (see FIG. 5), to the shaft 9 mounted so as to be rotatable to and fro about the axis 9'.

The foil molded into the receiving grooves 48 of the conveyor roller 41 then runs, together with the straws 13 over the conveyor roller 41 along a quarter circle, until the second outer smooth foil 15 is supplied by the mating roller 47, designed as a sealing roller, and is sealed on. The mating roller 47 serving as a sealing roller completes the sealing in the region between the individual chambers for each drinking straw 13. A further sealing roller or two small lateral sealing wheels 37 likewise take effect in the region of the mating roller 47 serving as a sealing roller, in order to carry out edge-sealing on the band of straws 55. There then follows a draw-off roller 30 which, as already mentioned above, mainly performs the function of a form roller. In this region, the band of straws 55 is cooled along a partial periphery, specifically with the exactly predetermined distance between the drinking straws 13 being maintained. Consequently, the precise form of the band of straws 55 is stabilized in this region.

Figure 4:
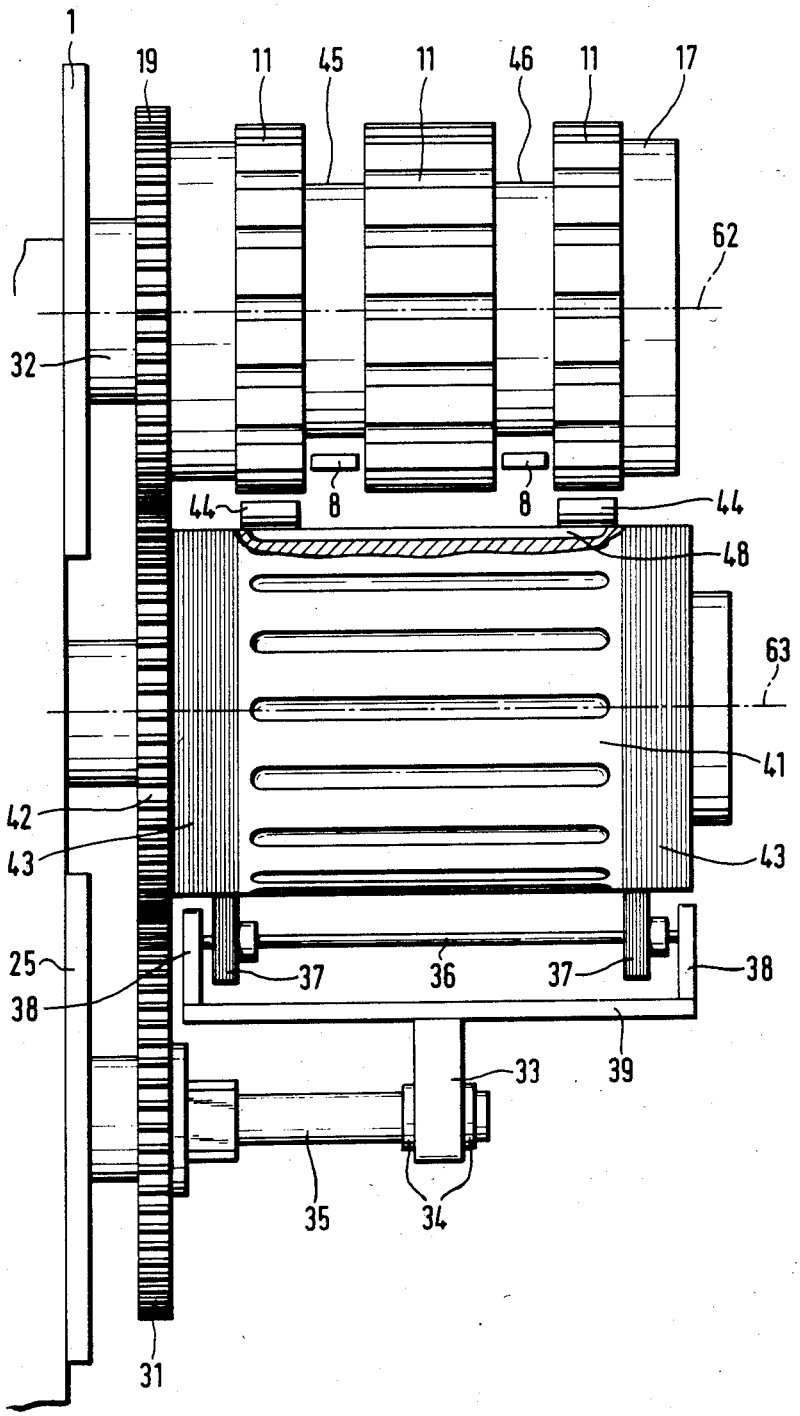
FIG. 4 shows the apparatus illustrated in FIG. 3 in a side view according to the arrow "A" in FIG. 3.
Figure 5:
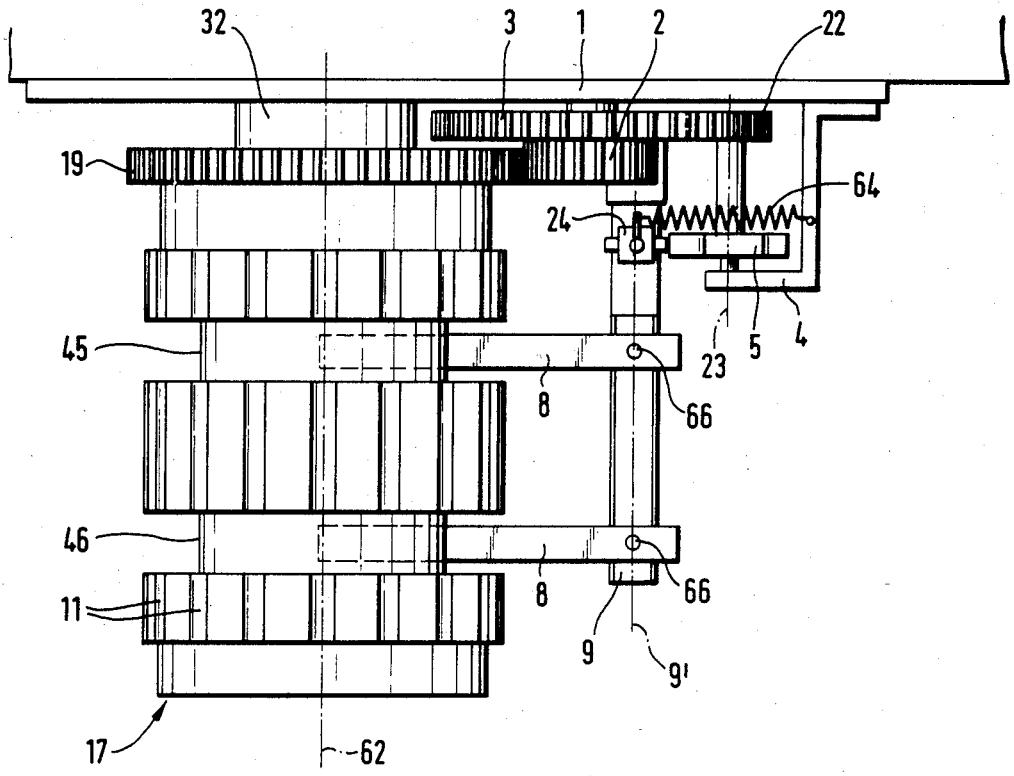
FIG. 5 shows the apparatus illustrated in FIG. 3 in a plan view according to the arrow "B" in FIG. 3.

As can be seen from FIG. 4, the conveyor roller 41 also has sealing edges 43 which can be heated to the sealing temperature and which are intended for carrying out the edge-sealing more effectively. As can be seen in FIGS. 3 and 4, the additional edge-sealing wheels 37 are mounted rotatably on a forked frame 33, 38, 39 mounted pivotably about a horizontal axle 35, the common axle 36 being mounted rotatably in the two prongs 38 of the above-mentioned forked frame. The sealing wheels 37 and the sealing edges 43 of the conveyor roller 41 are each profiled, preferably in the form of ribs extending over the periphery. The sealing wheels 37 are pressed against the periphery of the mating roller 47 serving as a sealing roller by means of a tension spring 49 which engages on an arm 26 fastened to the stem 33 of the forked frame. The other end of the tension spring 49 is fastened to the machine frame (fastening point 28). The pivot axle 35 of the forked frame 33, 38, 39 extends, like the common axle 36 of the edge-sealing wheels 37, horizontally and parallel to the axes of rotation 62, 63 and 65 of the suction roller 17, the conveyor roller 41 and the mating roller 47 respectively.

According to FIG. 4, the foil-receiving and straw-receiving grooves 48 of the conveyor roller 41 are located between the two outer sealing edges 43.

Directly adjacent to the transfer point for the drinking straws 13 from the suction roller 17 to the conveyor roller 41 is a mouthpiece 44 which ensures that the drinking straws 13 are introduced in an orderly fashion into the region between the two foil sheets 14, 15, converging in the roller gap between the conveyor roller 41 and the mating roller 47, and which is designed in the form of two shoes which are arranged at a distance from one another and which each extend over the part of the conveyor roller 41 located between the point of straw transfer from the suction roller 17 to the conveyor roller 41 and the gap between the conveyor roller 41 and the mating roller 47, so that the straws 13 pressed by the transfer fingers 8 into the straw-receiving grooves 48 of the conveyor roller 41, together with the foil sheet 14 located underneath, are retained in the receiving grooves 48 essentially until they come up against the other outer foil 15. According to FIG. 4, the two shoes 44 respectively cover the outer end regions of the receiving grooves 48.

As already explained above, all the moving parts of the apparatus described are driven centrally, and the drive power or drive torque is preferably introduced via the conveyor roller 41. This is connected fixedly in terms of rotation to a gear wheel 42 which meshes with a corresponding gear wheel 19 of the suction roller 17. This, in turn, interacts with the smaller gear wheel 2 of a stepped gear wheel, the larger gear wheel 3 of which meshes with a gear wheel 22 connected fixedly in terms of rotation to the cam plate 5. Furthermore, the central gear wheel 42 connected fixedly in terms of rotation to the conveyor roller 41 meshes with an intermediate gear wheel 31 which acts on a gear wheel 29 connected fixedly in terms of rotation to the draw-off roller 30. In the embodiment according to FIG. 3, the outside diameters of the suction roller 17, conveyor roller 41, mating roller 47 and draw-off roller 30 and the mean diameters of the associated gear wheels 42, 19, 31 and 29 are respectively the same, so that an essentially stress-free passage of the foil sheets 14, 15 and draw-off of the band of straws 55 are guaranteed.

According to FIG. 2, both the suction roller 17 and the conveyor roller 41, mating roller 47 and draw-off roller 30, as well as the intermediate gear wheel 31 and the stepped gear wheels, 2, 3, are each mounted overhung on the machine frame or appropriate bearing plates 1 and 25. Only the cam plate 5 and the associated gear wheel 22 are mounted rotatably about the axis 23 between a bearing plate 1 fastened to the machine frame and an L-shaped bearing bracket 4.

The forked frame 33, 38, 39 is also mounted overhung, the pivot bearing on the horizontal axle 35 being identified by reference numeral 34 in FIGS. 3 and 4. By means of the pivot bearing 34, the horizontal axle 35 can be connected firmly to the gear wheel 31 and can rotate with it.

Of course, the draw-off roller 30 likewise has straw-receiving grooves 50 which are distributed over its periphery at the same distance from one another as on the suction roller 17 or conveyor roller 41 and which extend parallel to the axis of rotation 40 of the draw-off roller 30. A certain meshing between the band of straws 55 and the draw-off roller 30 takes place in this way, thus ensuring that the band of straws 55 is drawn off reliably and free of slip.

In the embodiment according to FIGS. 2 to 5, the abovementioned straw stripper is formed by the closing wall 12 of the funnel 18 which is at the rear as seen in the direction of movement (S) of the suction roller 17. On the other hand, the closing wall 51 of the funnel 18, this closing wall being at the front as seen in the direction of movement (S) of the suction roller 17, is designed as a vibrating or shaking wall and can be set in vibration by means of an external drive. This ensures that the straws 13 are always loosened in the lower region of the funnel 18, thus guaranteeing that they will be taken up by the suction roller 17 without difficulty.

According to FIG. 2, the lower edge of the vibrating or shaking wall 51 corresponds to the contour of the cylindrical surface of the suction roller 17; that is to say appropriate wall portions 20, 21 penetrate into the two peripheral grooves 45, 46.

The design of the straw-receiving grooves 11 of the suction roller 17 is of particular importance for reliable operation of the apparatus described. According to FIGS. 6 and 7, the center planes 52 of the straw-receiving grooves 11 of the suction roller 17 each form an angle ($\alpha$) of approximately 10° to 45°, preferably approximately 30°, relative to the radial line 16, and, as seen in a radially outward direction, the center planes 52 are each inclined at this angle $\alpha$relative to the radial line 16 counter to the direction of movement (S) of the suction roller 17. This position of the straw-receiving grooves 11, which is inclined counter to the direction of rotation (S) of the suction roller 17, guarantees that the stripper 12 or the corresponding closing wall of the funnel 18 detains, without the danger that the drinking straws 13 will be damaged, any surplus straw which is taken up by a straw-receiving groove 11. The detained straw 13 can move out of the straw-receiving groove 11 again without the danger of being crushed.

Figure 6:
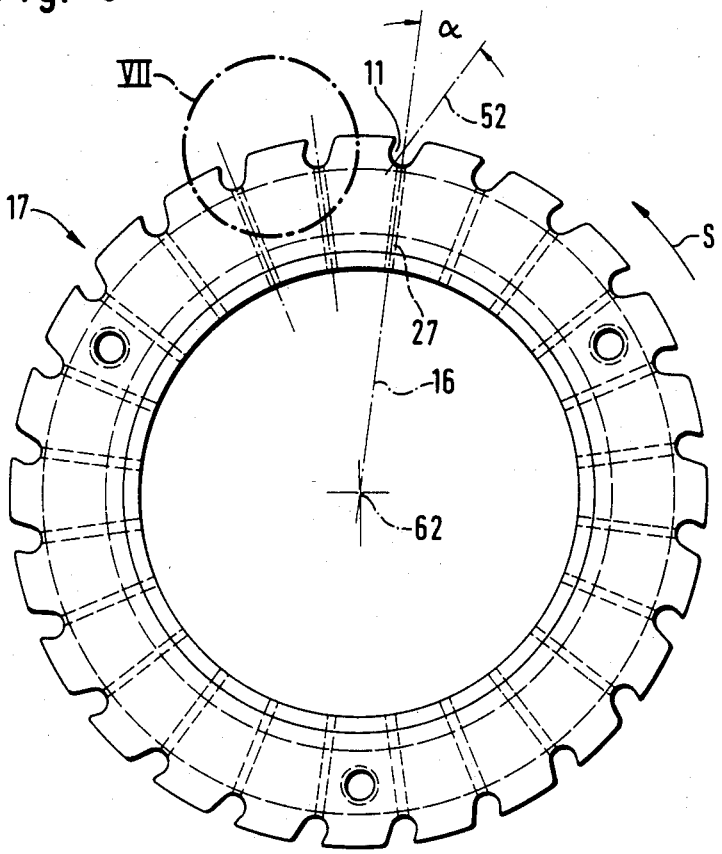
FIG. 6 shows, in a front view and on an enlarged scale, the straw-separating device designed as a suction roller.
Figure 7:
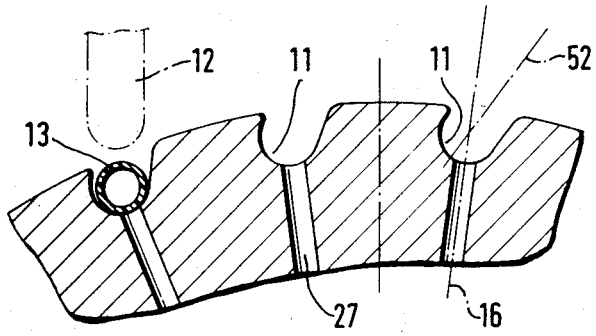
FIG. 7 shows, on a further enlarged scale and in section, a detail of the straw-separating device according to FIG. 6.

The suction channels 27 assigned to each straw-receiving groove can be seen in FIGS. 6 and 7, and these lead to a common vacuum chamber which is located within the suction roller 17 and which can be connected fluidically to a vacuum source. The fluidic connection is made by means of the pivot bearing 32 of the suction roller 17 (see FIG. 4).

According to FIG. 1, both the apparatus for introducing the drinking straws 13 into the region between the two packaging foils 14 and 15 and the punching device 57 and 60 as well as the winding drum 61 are located on a common stand 6. A compensating roller 7, which is mounted so as to be movable up and down in a vertical plane in a manner corresponding to the compensating roller 56, is likewise provided at the outlet side of the punching device 57, 60. It is thereby possible to drive the winding drum 61 continuously.

The sealing regions of the conveyor roller 41 are preferably maintained at a temperature of approximately 120°. The cylindrical-surface temperature of the mating roller 47 is approximately 130° C. The edge-sealing wheels 37 are preferably unheated. Also preferably located on the common axle 36 of the edge-sealing wheels 37 is a straw-band supporting roller (not shown), the outside diameter of which is such that the difference between the outside diameter of the sealing wheels 37 and the outside diameter of the straw-band supporting roller is slightly greater than double the straw diameter. The edge-sealing wheels 37 are profiled, preferably being provided with several ribs extending over the periphery.

What is claimed is:

1. A process for producing consecutive packages for drinking straws, or the like, that are received spaced from one another between two foil sheets secured to one another, said method comprising:

(a) providing a supply funnel for a plurality of drinking straws arranged in parallel relationship, said supply funnel including a discharge opening having a width greater than the diameters of two straws;

(b) providing a first carrier for receiving and carrying drinking straws in parallel, spaced relationship, said carrier having a plurality of spaced, parallel grooves, each groove adapted to receive a single straw;

(c) moving said first carrier past said funnel discharge opening to deposit individual straws in individual grooves in said first carrier;

(d) retaining the straws in the grooves by means of suction;

(e) providing a second carrier for receiving and carrying straws in parallel, spaced relationship, said second carrier having a plurality of spaced, parallel grooves, each groove adapted to receive a signle straw;

(f) passing a first packaging foil over the surface of said second carrier;

(g) carrying the straws by means of said first carrier to said second carrier;

(h) positively transferring individual straws from the grooves in said first carrier to the grooves in said second carrier with movable transfer means;

(i) simultaneously pressing the transferred straws and the packaging foil into the grooves in said second carrier;

(j) passing a second packaging foil over said first packaging foil to enclose the straws therebetween;

(k) joining together the first and second foils outwardly of the straws to form a band of spaced, parallel straws positioned between the first and second foils; and (l) forming spaced cuts in said band between consecutive straws.

2. An apparatus for producing consecutive packages for drinking straws or the like, which are spaced from one another between two converging foil sheets that are welded or glued to one another, said apparatus comprising: a straw supply funnel for receiving a plurality of straws having their axes substantially parallel and having an elongated orifice through which straws are adapted to pass, the orifice having a long dimension and and a short dimension, the short dimension of the orifice being greater than two straw diameters; straw-separating and carrying means positioned below the funnel to receive straws from the funnel and including a plurality of parallel peripheral straw receptacles having suction apertures and spaced from one another for transporting straws at a predetermined parallel spacing; said straw-separating and carrying means being movable with at least two straw receptacles directly opposite the orifice of the supply funnel; wherein the straws are received in the straw receptacles and are retained on the straw-separating and carrying means by suction applied through the suction apertures therein; and at least one transfer member movable to and fro transversely to the path of movement of the straws on said carrying means and which positively transfers the straws individually and at a fixed rate from said carrying means to a conveyor means that conveys the straws into the region between the converging foils.

3. An apparatus as claimed in claim 2, including shoe means for introducing the straws into the region between the converging foils and located downstream of the transfer member.

4. An apparatus as claimed in claim 2 or 3, wherein the transfer is cam-operated to intermittently transfer straws from said straw separating and carrying means.

5. An apparatus as claimed in claim 2, wherein the straw-separating and carrying means is a suction roller having straw receiving grooves distributed approximately uniformly over the periphery thereof and extending approximately parallel to the axis of rotation of the roller, said grooves serving as straw receptacles and connected to a vacuum source at least along a straw transport path, the suction roller having at least one peripheral groove into which the transfer member is movable to and fro transversely to the path of movement of the straws, said transfer member received in said groove when in a retracted initial position.

6. An apparatus as claimed in claim 5, wherein center planes of the straw-receiving grooves of the suction roller each form an angle of approximately 10° to 45° relative to a radial line from the axis of rotation of the suction roller and the center planes are each inclined at the same angle, the grooves being positioned to face counter to the direction of movement of the suction roller.

7. An apparatus as claimed in claim 5, wherein the width of the orifice of the straw supply funnel, in the conveying direction of the straw-separating and carrying means, is of a size that at least two straw-receiving grooves in said straw-separating and carrying means are always located simultaneously opposite the orifice.

8. An apparatus as claimed in claim 5, including a conveyor roller adjacent the straw-separating and carrying means, said conveyor roller having straw-receiving grooves distributed uniformly over the periphery and which extend approximately parallel to the axis of rotation, one of the two Packaging foils being guide over said conveyor roller, wherein the straws extracted from the straw receptacles of the straw-separating and carrying means are pressed by the transfer member, together with the foil guided over the conveyor roller, into the straw-receiving grooves of the conveyor roller.

9. An apparatus as claimed in claim 2, wherein the width of the orifice of the straw supply funnel, in the conveying direction of the straw-separating and carrying means, is of a size that at least two straw-receiving grooves in said straw separating and carrying means are always located simultaneously opposite the orifice.

10. An apparatus as claimed in claim 9, including a conveyor roller adjacent the straw-separating and carrying means, said conveyor roller having straw-receiving grooves distributed uniformly over the periphery and which extend approximately parallel to the axis of rotation, one of the two packaging foils being guided over said conveyor roller, wherein the straws extracted from the straw receptacles of the straw-separating and carrying means are pressed by the transfer member, together with the foil guided over the conveyor roller, into the straw-receiving grooves of the conveyor roller.

11. An apparatus as claimed in claim 2, including a conveyor roller adjacent the straw-separating and carrying means, said conveyor roller having straw-receiving grooves distributed uniformly over the periphery and which extend approximately parallel to the axis of rotation, one of the two packaging foils being guided over said conveyor roller, wherein the straws extracted from the straw receptacles of the straw-separating and carrying means are pressed by the transfer member, together with the foil guided over the conveyor roller, into the straw-receiving grooves of the conveyor roller.

12. An apparatus as claimed in claim 11, including a mating roller which is in surface contact with the conveyor roller and over which the other packaging foil is guided, and a guide shoe located above the part of the conveyor roller lying between the point of straw transfer from the straw-separating and carrying means to the conveyor roller and a nip between the conveyor roller and the mating roller for introducing the straws into the region between the converging foils and for retaining the straws that are pressed into the straw-receiving grooves of the conveyor roller in these grooves essentially until they contact the other packaging foil.

13. An apparatus as claimed in claim 12, wherein the mating roller that contacts the conveyor roller is a sealing roller with a cylindrical surface which can be heated to a sealing temperature.

14. An apparatus as claimed in claim 13, wherein the conveyor roller has sealing edges which can be heated to the sealing temperature.

15. An apparatus as claimed in claim 13, including edge-sealing means having sealing wheels which can be heated to a sealing temperature and which roll on the peripheral surface of the mating roller, and means for Pressing the sealing wheels against the peripheral surface of the mating roller.

16. An apparatus as claimed in claim 12 including a straw-band.

17. An apparatus as claimed in claim 16, including central drive means for driving the suction roller, the transfer member, the conveyor roller, the mating roller and the draw-off roller, which are drivingly connected with each other, the driving torque being introduced via the conveyor roller.

18. An apparatus as claimed in claim 2, wherein the straw supply funnel includes a first closing wall defining an edge of said orifice and being at a downstream side of said orifice relative to the direction of movement of the suction roller and being in closely spaced relationship with the surface of the suction roller.

19. An apparatus as claimed in claim 18, wherein the straw supply funnel includes a second closing wall spaced from said first closing wall and defining an edge of said orifice, said second closing wall being at an upstream side of said orifice relative to the direction of movement of the suction roller, and said second closing wall being supported for vibration to maintain the straws at said orifice in a loose, free-flowing condition.

* * * * *